United States Patent [19]

Taguchi

[11] 4,225,011

[45] Sep. 30, 1980

[54] METHOD AND DEVICE FOR SILENCING THE EXHAUST NOISE OF INTERNAL COMBUSTION ENGINES

[76] Inventor: Moriyuki Taguchi, 675-44, Aritama-Nishimachi, Hamamatsu-shi, Shizuoka-ken, Japan

[21] Appl. No.: 963,764

[22] Filed: Nov. 27, 1978

Related U.S. Application Data

[60] Division of Ser. No. 810,618, Jun. 27, 1977, Pat. No. 4,149,611, which is a continuation of Ser. No. 580,540, May 23, 1975.

[51] Int. Cl.[3] ..... F01N 1/00

[52] U.S. Cl. ..... 181/269; 181/296

[58] Field of Search ..... 181/230, 232, 240, 255, 181/265, 264, 268, 269, 272, 275, 296, 212

[56] References Cited

U.S. PATENT DOCUMENTS

| | | | |
|---|---|---|---|
| 2,240,052 | 4/1941 | Pomries | 181/265 |
| 3,462,947 | 8/1969 | Nowak | 181/269 |
| 3,842,599 | 10/1974 | Ehlen | 181/265 |

*Primary Examiner*—L. T. Hix
*Assistant Examiner*—Benjamin R. Fuller
*Attorney, Agent, or Firm*—Donald D. Mon

[57] ABSTRACT

An exhaust gas silencing system wherein standing waves are utilized in a silencing chamber to reduce low frequency components of noise, and a downstream muffler is utilized to reduce the high frequency components of noise. An expansion chamber can be utilized further to reduce the pressure of the sound waves.

3 Claims, 24 Drawing Figures

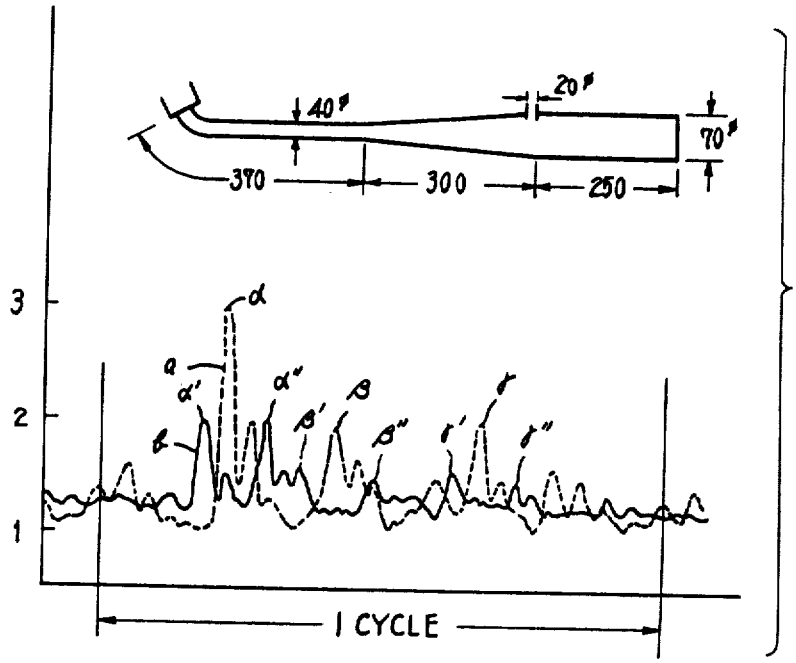
FIG. 4
FIG. 5
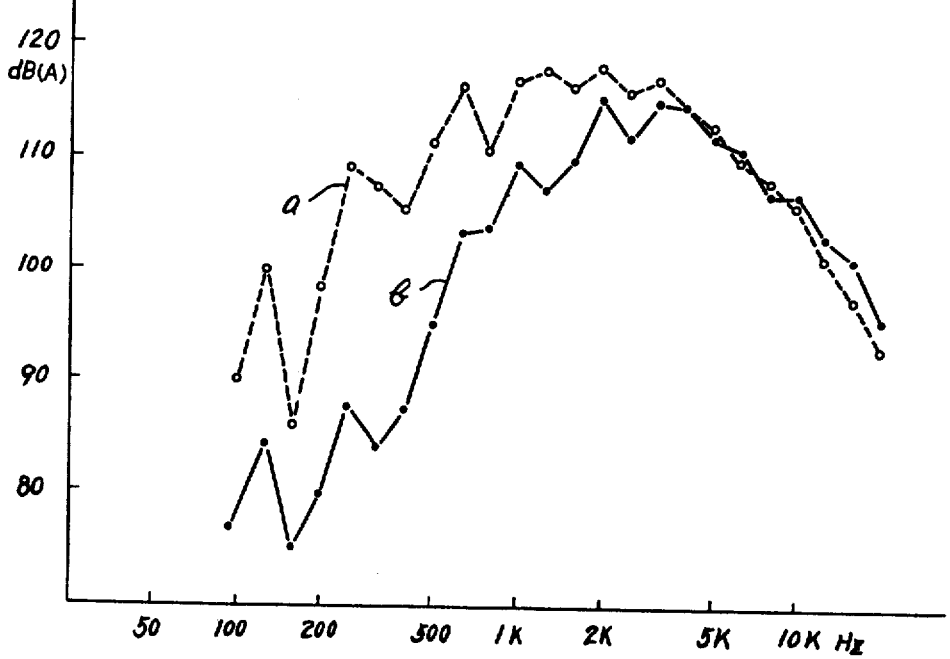

180
181
182
183
184
185
186
187
188
189
190
191
192
195
196
196a
197
198
199
200
201
202
203
205
206
206a
206b
207
208
209
210
211
212
213
19
20

METHOD AND DEVICE FOR SILENCING THE EXHAUST NOISE OF INTERNAL COMBUSTION ENGINES

CROSS-REFERENCE TO OTHER APPLICATIONS

This application is a division of United States patent application Ser. No. 810,618, filed June 27, 1977 now U.S. Pat. No. 4,149,611, which in turn is a continuation of United States patent application Ser. No. 580,540, filed May 23, 1975, both entitled "Method and Device for Silencing the Exhaust Noise of Internal Combustion Engines".

This invention relates to silencing of the noise in the exhaust stream from internal combustion engines.

The exhaust noise from internal combustion engines is generally considered as consisting of (1) sound which is generated when gases of combustion are exhausted from an exhaust port of the engine where they rapidly expand, and (2) sound generated when the exhaust gas flows through an exhaust pipe from the exhaust port. The first portion is propagated in the form of pulsating pressure waves, including frequency components which are substantially proportional to the engine speed. This portion of the sound therefore includes a relatively large amount of low frequency components. The second portion is generally considered as comprising sound generated by eddies and the like in the exhaust gas flow, and has a relatively small amount of low frequency components and a relatively high proportion of high frequency components.

It is relatively straightforward to muffle high frequency components with mufflers of modest size. However, it has generally been necessary to use relatively large mufflers for silencing the low frequency components of the sound. Particularly in situations where the available space for the muffler is limited, for example on motorcycles, it has heretofore been impossible to use a conventional muffler or sufficiently large size to absorb substantially all of the low frequency noise components. Therefore, on smaller vehicles it has been difficult to silence exhaust noises which include a large amount of low frequency components. These vehicles tend sometimes to produce an undesirable amount of exhaust noise for this reason.

One objective of the present invention is to provide an effective and improved method and device for silencing exhaust noises, especially of the lower frequency components, which is of a relatively small size. The method and device of the present invention are characterized by the elimination of the lower frequency noise components in a silencing chamber, and of the higher frequency noise components in a muffler more suitable for disposing of the higher frequency noise.

The following United States and foreign patents relate to previous efforts to reduce noise:

| | | |
|---|---|---|
| Bourne | U. S. Pat. No. | 2,017,748 |
| Leadbetter | U. S. Pat. No. | 2,360,429 |
| Hasui | U. S. Pat. No. | 3,589,469 |
| Tenney | U. S. Pat. No. | 3,665,712 |
| Fichtel & Sachs | West Germany patent No. | 595,425 (1934) |
| Martin | West Germany patent No. | 802,204 (1949) |
| Anero | West Germany patent No. | 964,915 (1957) |
| Bauer | West Germany patent No. | 1,121,410 (1958) |

The invention is carried out by providing a silencing chamber downstream from the exhaust port of the engine, which chamber includes a reflecting wall. The reflecting wall causes standing waves to be developed in the silencing chamber. A standing wave has "nodes" of least amplitude linked by "loops". An exit port from this silencing chamber is provided at a location axially adjacent to a node. Gases exhausted from the exhaust port will have low frequency noise components. Gases coming out from the exit port have the lower amplitude of the node, rather than the higher amplitude of the loops between the nodes. Accordingly, the low frequency noise will have been reduced.

According to another feature of the invention, a muffler receives the effluent gas stream from the exit port and muffles the higher frequency components which were not muffled in the silencing chamber. The exhaust stream leaving the muffler is therefore substantially devoid of both low and high frequency noise components.

According to still another preferred but optional feature of the invention, means is provided for moving the reflecting wall or the exit port axially in the silencing chamber for the purpose of relating the relative positions of the node and of the exit port. This provides for both frequency and temperature compensation, if desired.

According to still another preferred but optional feature of the invention, a catalytic converter can be placed downstream from the silencing chamber so as to perform its catalytic function on the exhaust stream without exposure to the damaging effects of the low frequency vibrations. Catalytic elements have frequently been rapidly destroyed in motorcycle mufflers, for example, by the low frequency noises.

The above and other features of this invention will be fully understood from the following detailed description and the accompanying drawings, in which:

FIGS. 3, 4 and 5 are graphs illustrating certain operative features of this invention;

Figures 6, 7, 8, 9:
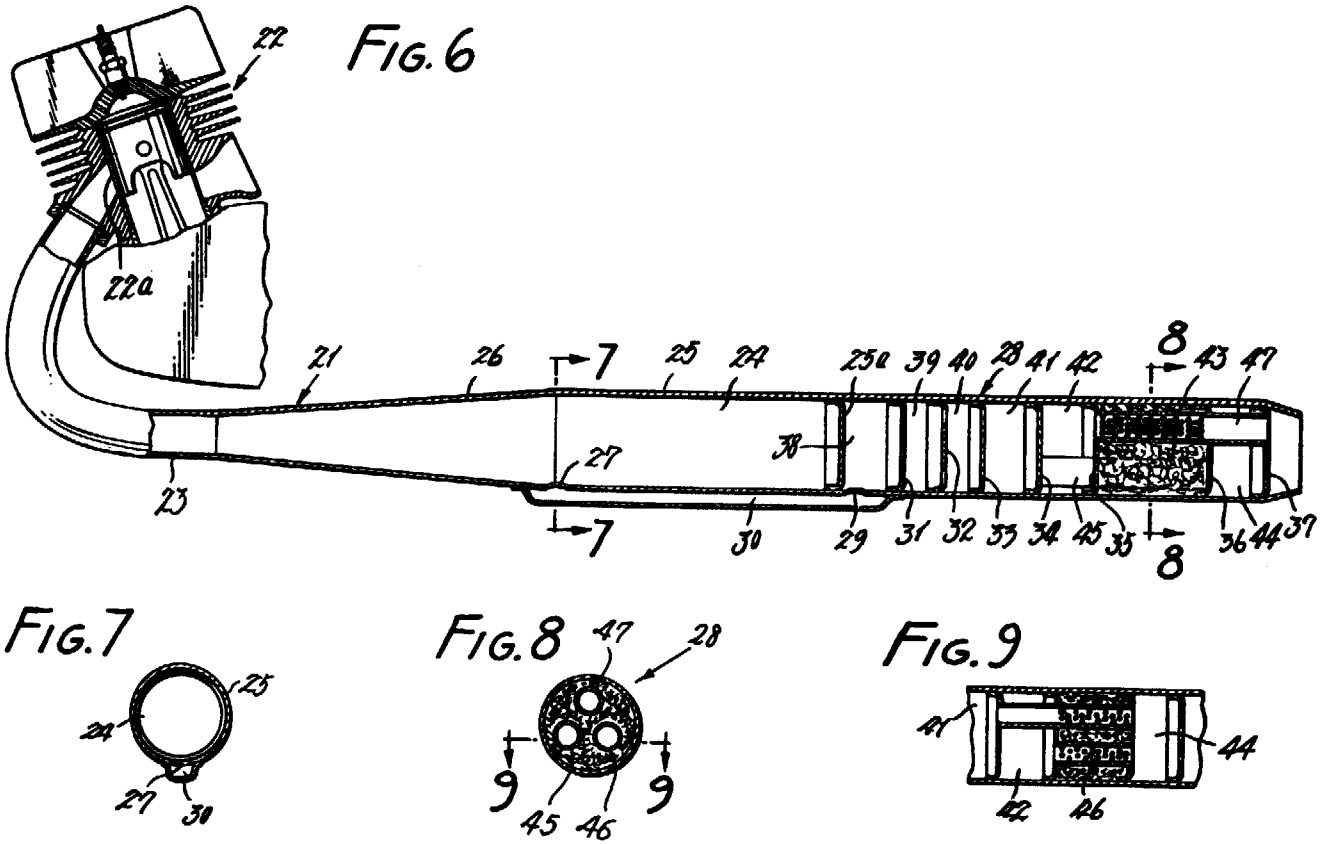
FIG. 6 is an axial cross-section showing a modification of the device of FIG. 2 together with a muffler.
Figure 10:
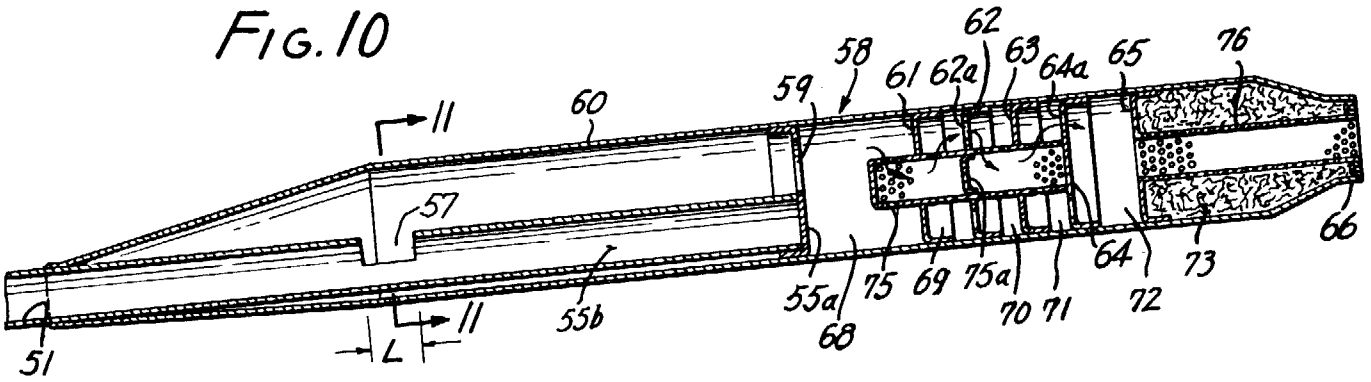
Figure 11:
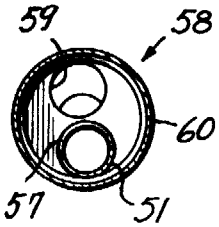
Figures 16, 17, 18, 19, 20:
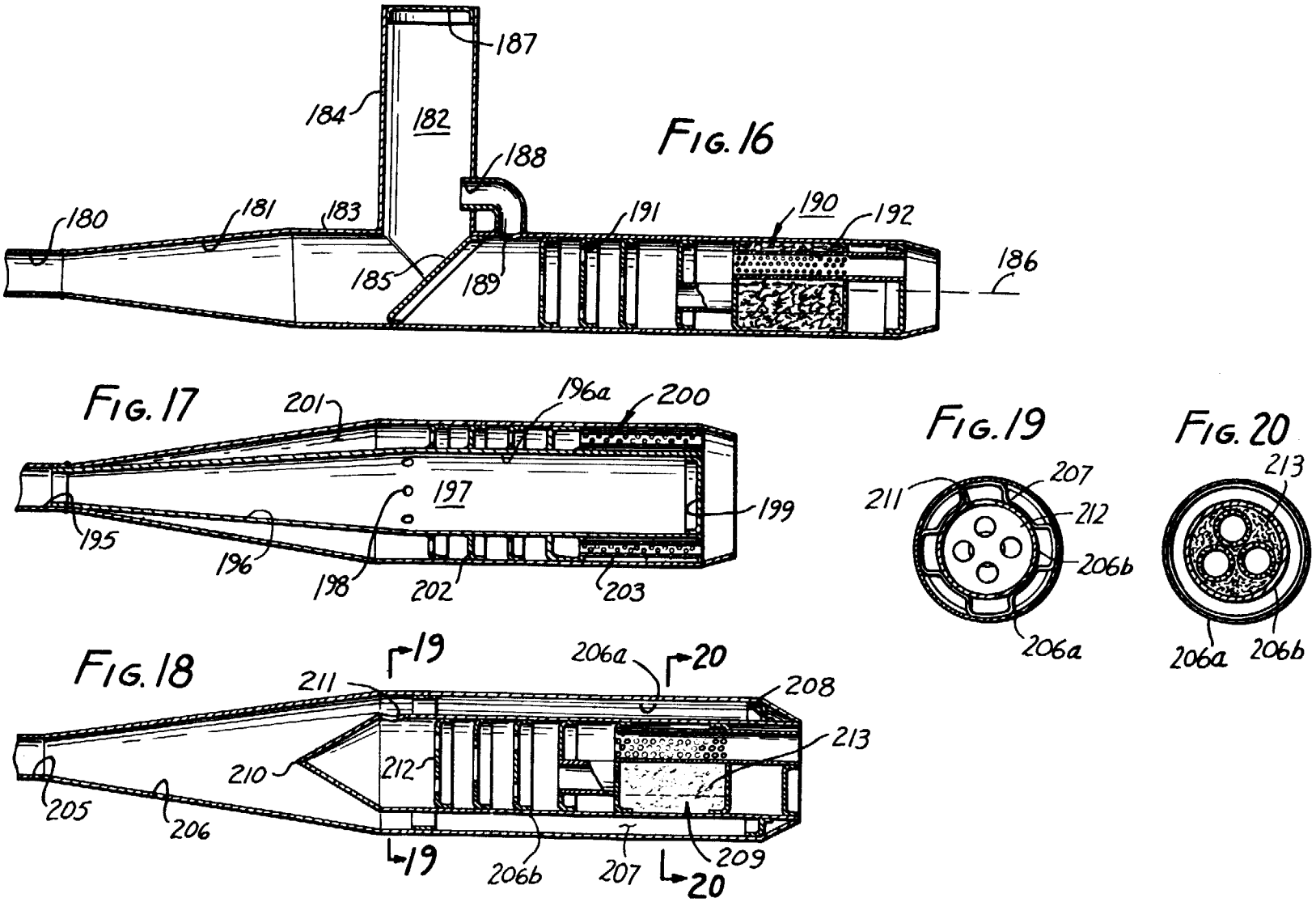
Figure 22:
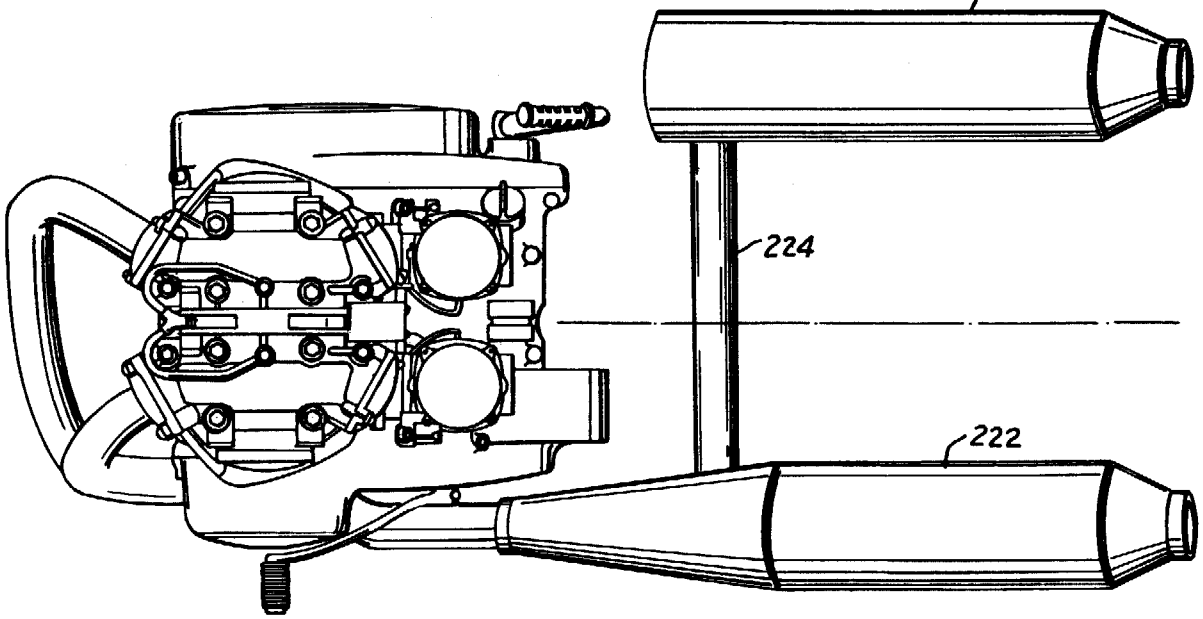
Figure 21:
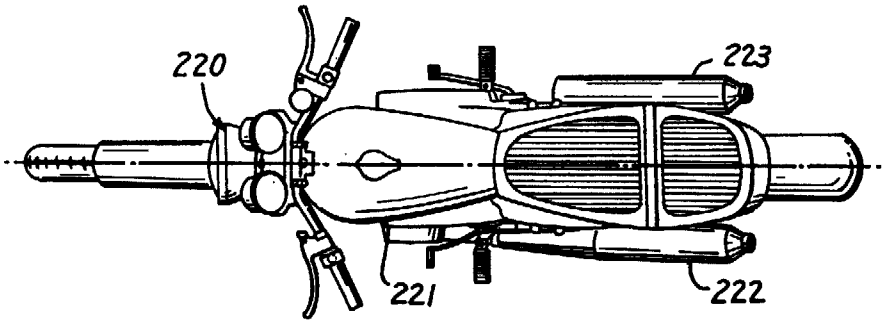
Figure 23:
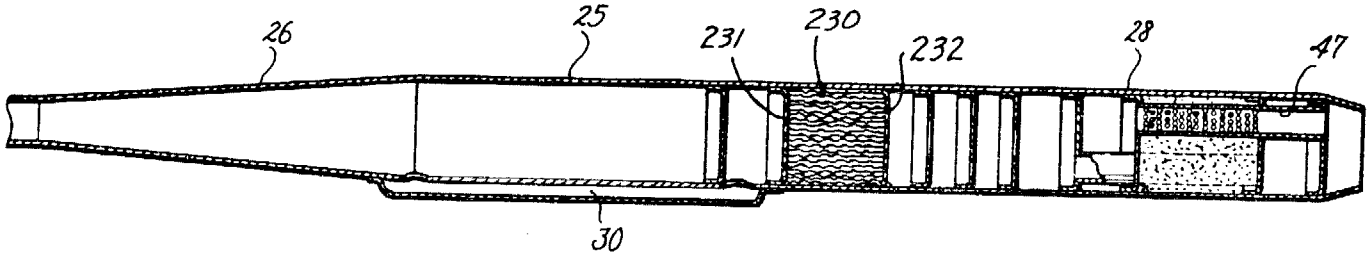
Figure 24:
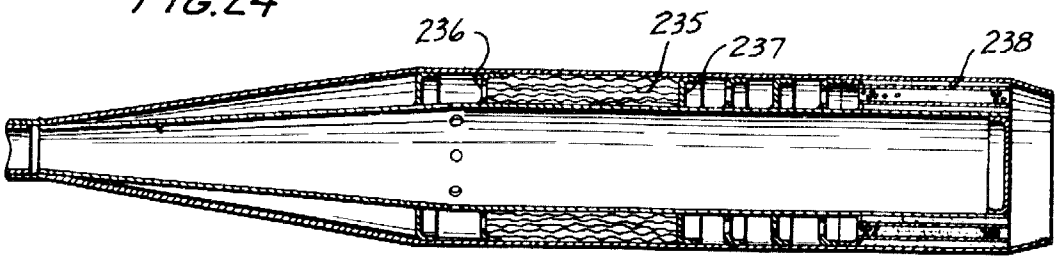

FIGS. 7 and 8 are cross-sections taken at lines 7—7 and 8—8, respectively, of FIG. 6;

FIG. 9 is a cross-section taken at line 9—9 of FIG. 8;

FIG. 10 is an axial section of yet another embodiment of the invention;

FIG. 11 is a cross-section taken at line 11—11 of FIG. 10;

FIGS. 12—18 are axial cross-sections showing other embodiments of the invention;

FIGS. 19 and 20 are cross-sections taken at lines 19—19 and 20—20 in FIG. 18;

FIG. 21 is a top view of a motorcycle incorporating another embodiment of the invention;

FIG. 22 is a showing of a portion of FIG. 21 with the chassis of the motorcycle removed; and FIGS. 23 and 24 are axial cross-sections of other embodiments of the invention incorporating catalysts.

Figure 1:
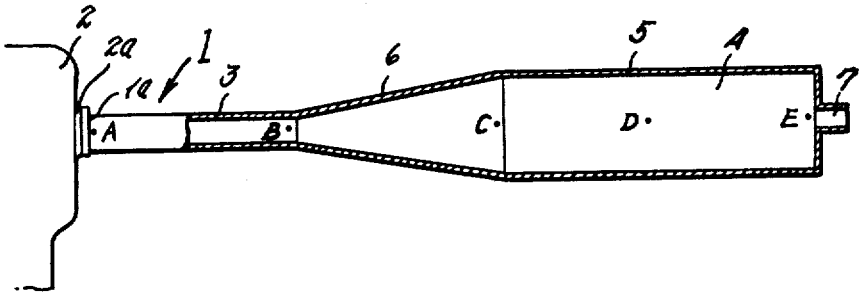
FIG. 1 (PRIOR ART)
FIG. 1 illustrates a prior art first expansion chamber.
Figure 2:
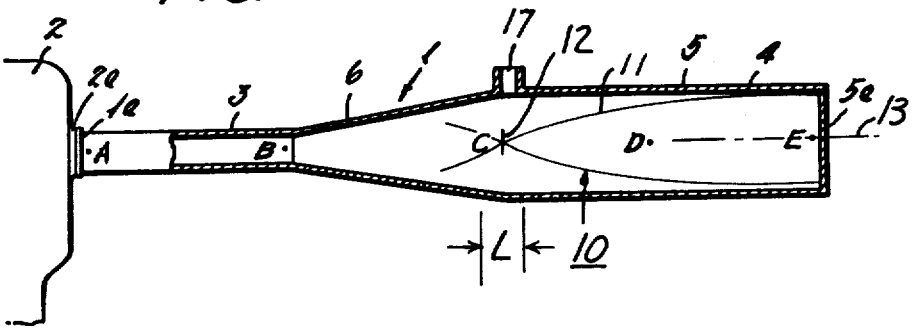
FIG. 2 is an axial cross-section showing the presently preferred embodiment of a silencing chamber for use in this invention.

FIGS. 1 and 2 illustrate, respectively, a conventional first expansion chamber, and a silencing chamber according to the invention. In FIG. 1 a conventional exhaust pipe 1 is connected at 1*a* to an exhaust port 2*a* of an internal combustion engine, for example a single-cylinder, two-stroke engine. Pipe 1 includes a cylindrical front portion 3 (whose end at point B constitutes an "entrance point") having a relatively small diameter. The first expansion chamber 4 comprises a cylindrical rear portion 5 having a larger diameter than that of the entrance port. A conical portion 6 is placed between portions 3 and 5. Chamber 4 is comprised of portions 5 and 6. An exhaust gas outlet 7 is formed at the rear end of the first expansion chamber.

In the presently preferred embodiment of the invention, as shown in FIG. 2, portions which correspond to portions of FIG. 1 are given corresponding numbers. These two devices differ in that chamber 4 is denoted as a silencing chamber in FIG. 2, and has a reflecting wall 5*a* without a port, and an exhaust gas outlet port 17 exhausting through the sidewall of the silencing chamber at a location yet to be discussed. In FIG. 1 the end wall is ported and the sidewall is imperforate.

In accordance with known theory, lower frequencies, say on the order of between about 300 and 1,000 cycles per second, will tend, in a chamber such as shown in FIG. 2, to form standing waves, for example, standing wave 10. Such a wave has portions of loop 11 of pressure and nodes 12 of pressure. As schematically shown in FIG. 2, the amplitude is greatest in the loop 11 at least at node 12. The objective of the invention is to exhaust the gases through an exit port 17 from a region as near as possible to a node so that only reduced low frequency components of the noise accompany the stream. The axial location of the nodes varies with the frequency and with the temperature. Also, while the most frequent nodal positions occur at odd whole multiples of one-quarter wave length, they are also formed at other fractions and, of course there will be standing waves of many different frequencies. In addition, the wave length of a given frequency varies with the temperature. Accordingly, some empirical adjustment of the location must be made after the best theoretical location is calculated, in order to be certain that the most troublesome components of the particular sound are silenced. Also, the temperature is not evenly distributed, and therefore some empirical adjustment will be needed.

Ordinarily, the frequency of most concern will be determined by measuring and observing the characteristics of the exhaust stream from a particular engine whose exhaust stream is to be quieted. The best theoretical location for low frequency silencing is one-quarter wave length from the reflecting wall at warm-engine, warm-silencer conditions.

When the relative locations of the node and of the exhaust port are not adjustable, there will be some theoretical lessening of siliencing efficiency at different temperatures. However, in a practical silencer on a typical engine, nodes from other standing waves of nearby frequencies, and nodes formed at different fractions of a wave length, will usually cause a diminished output of the low frequency noise components, even if silencing of the frequency of greatest interest is somewhat less effectively reduced.

It will be found that there is a band of axial length "L" along the axis 13 within which the node for the frequency of most interest will customarily stand for most operative temperatures. The location of such a node can be approximately determined theoretically, and ultimately must be adjusted experimentally, but this requires little effort. As heretofore stated, the adjustment seeks the most effective nodal position, and also compensates for the effect of unequal temperature distribution. The objective of the invention, therefore, is to provide an exit port of adequate capacity to pass the exhaust gases at a region within the band. One or more exit ports may be provided, but one will usually be sufficient. When more than one is provided, all will lie within the said band. Some theoretical studies have shown that the exit port functions most effectively to remove about 94% of a low frequency of interest when its axial length is less than about 4 cm. and preferably less than about 2 cm. The smaller the length of the exit port, the sharper the cutoff. There is a surprisingly broad useful band "L", which can be as great as about 10 cm. The above criteria are respective to frequencies of about 500 Hertz, the wave length of which, at about 280° C., is about 1 meter. The exit port is conveniently located about 0.25 meter from the reflecting wall, i.e., about one-quarter length. It is often important to eliminate 500 Hertz noise.

Higher frequency components (i.e., above about 1000 Hertz) of the noise do not tend to form standing waves in the manner indicated in FIG. 2, and these components will generally leave the silencing chamber along with the gas, and must be silenced by means located downstream from the silencing chamber.

Figure 3:
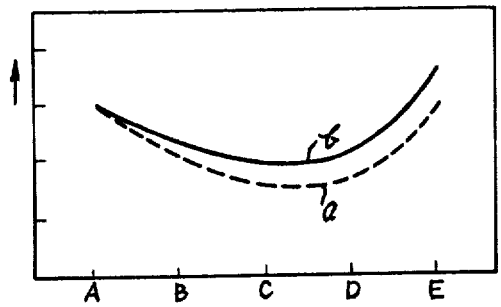

In the operation of the engine, pulsating pressure waves in the exhaust gas enter the exhaust pipe 1. In FIGS. 1 and 2, the maximum values of the pulsating pressures at the points A, B, C, D, and E are as shown in FIG. 3. In FIG. 3, the curved dashed line "a" shows the variation of the maximum value of the pulsating pressure in the exhaust pipe at the various points along axis 1 in the device of FIG. 1. The curved solid line "b" shows the variation of the maximum value of the pulsating pressure in the exhaust pipe of the construction shown in FIG. 2.

As is apparent from FIG. 3, the maximum value of the exhaust pressure is high at both ends of the exhaust pipe in both constructions, and is lower at an intermediate portion thereof. This tendency can be calculated theoretically and observed experimentally. In the exhaust pipe of FIG. 2, the exhaust gases are removed from an axial location where the maximum value of the pulsating pressure wave is relatively low, and in that of FIG. 1, where they are relatively high. The axial pulsating pressure in the chamber of FIG. 2 is higher at every compared point than in the chamber of FIG. 1, but in the chamber of FIG. 1, the gas stream exits where the pressures are highest, and in the device of FIG. 2, it exits where they are lower, and this lower pressure is less than the exit pressure in FIG. 1. Therefore, the actually exiting noise pressures are significantly lower with the device of FIG. 2 than with the device of FIG. 1.

FIG. 4 shows the variation of pressure for one cycle of a two-stroke engine at the exhaust gas outlet ports 7 and 17 of the first expansion chamber and the silencing chamber, which are respectively shown in FIGS. 1 and 2. Again, the dashed line "a" represents conditions in the construction of FIG. 1, and the solid line "b" is that of the construction of FIG. 2. As will be apparent from the drawing, in the exhaust pipe of FIG. 1, after the maximum pressure $\alpha$, a few peaks appear in the pulsating pressure, as shown by the symbols $\beta$, and $\alpha$. In the exhaust pipe of FIG. 2, peaks $\alpha'$ and $\alpha''$, $\beta'$, $\beta''$, and $\delta'$ and $\delta''$ appear in the pulsating pressure to correspond to the pulsating pressure peaks $\alpha$, $\beta$, and $\alpha$ in the first expansion chamber of FIG. 1. Consequently, the number of the pulsating pressure waves having relative large amplitudes, and appearing for one cycle of the engine, is increased. However, the peak value of each pulsating pressure wave is very small compared with that of the peaks $\alpha$, $\beta$ and $\delta$ in the exhaust pipe in FIG. 1, because the pulsating pressure waves $\alpha$, $\beta$ and $\delta$ are divided into the pulsating pressure waves $\alpha'$ and $\alpha''$, $\beta'$ and $\beta''$, and $\delta'$ and $\delta''$, respectively. This means that the low frequecy components of the exhaust pulsating pressure wave are relatively decreased, and at the same time that the peak value of the pulsating pressure is lowered. This situation is experimentally observed and can be derived theoretically by gas dynamics analysis. The improved results are evident. Adjusting the distance between the reflecting wall end and the exhaust gas outlet port appears to affect the efficiency of the silencer, as previously discussed. In conventional internal combustion engines, it is suitable to determine the position of the exhaust gas outlet port so that it is effective against the pressure wave $\alpha$ of about 300 to 1,000 Hz, and such a construction appears to be generally useful, whatever the speed of the engine.

An internal combustion engine used for testing was a two-cylinder, two-cycle engine having a displacement of 350 cc and a maximum power output of 38 ps/7500 rpm. The engine was run in the test at 25° C. and at the speed of 7000 rpm. The dimensions of the silencer used in the test are shown in the upper portion of FIG. 4 in millimeters, together with the wave forms already described. This construction was varied to make the test corresponding to a device according to FIG.1 by placing the exit port in the reflecting wall to form the construction of FIG. 1 and closing the exit port in the sidewall.

FIG. 5 shows the frequency distribution of noise measured in the test of FIG. 4, in which the broken line "a" shows the noise in decibels (A scale) from the exhaust pipe shown in FIG. 1, and the broken line "b" shows the noise in decibels from the exhaust pipe of FIG. 2. Noise was measured at a location spaced from the respective exhaust outlet port by one meter. As shown in FIG. 5, in the exhaust pipe of the construction shown in FIG. 2, the low frequency components of the noise were substantially decreased.

FIGS. 6—9 show another embodiment of the present invention in which an exhaust pipe portion 21 is connected to an exhaust port 22a of a two-cycle internal combustion engine 22. The system 21 comprises a front portion 23 (entrance port) having a relatively small cross-sectional area, a cylindrical rear portion 25 having a larger diameter, and a conical portion 26 connecting them. In this embodiment, as in the others, the conical portion and rear portion comprise an "expansion chamber", in the sense of having an enlarged cross-section compared to portion 23, and also form the silencing chamber. The rear end is closed by reflecting wall 25a. An exhaust gas exit port 27 is provided near a boundary portion between the conical portion 26 and the rear portion 25 and is located in the band where the node of the standing wave having the frequency in question will be formed in accordance with the previously-described criteria.

A muffler portion 28 is formed integral with the cylindrical rear portion 25 of the exhaust pipe portion 21, and has an inlet port 29 connected to the outlet port 27 of the exhaust pipe portion 21 through an exhaust gas passage 30. The passage may conveniently be formed by a plate welded to the side of the device.

The muffler portion 28 is divided into chambers 38, 39, 40, 41, 42, 43, and 44 by partitions 31, 32, 33, 34, 35, 36, and 37. The chambers 38, 39, 40 and 41 communicate with one another through holes in the partitions 31, 32 amd 33. The chambers 41 and 44 are adapted to communicate with each other through a pipe 45, and the chambers 42 and 44 are also adapted to communicate with each other through a pipe 46. Chamber 42 is opened to atmosphere through a pipe 47. The pipes 45, 46 and 47 have a number of perforations through the sidewall thereof within the chamber 43. Chamber 43 is filled with sound-absorbing material, such as glass wool. This is a muffler construction especially well suited to the reduction of high frequency noise components.

Exhaust gas flows from the front portion 23 (entrance port) of the exhaust pipe portion 21, and into the silencing chamber 24, where the gas expands and forms a standing wave respective to the engine speed. The wave, wherever shown, is respective to a certain frequency generated by some specific engine speed. The panded gas flows through the exit port 27, through the exhaust gas passage 30 and the inlet port 29, and enters into the chamber 38 of the muffler portion 28.

The maximum value of the exhaust pulsating pressure wave has been lowered in the expansion chamber by expanding the gas, and low frequency components have been specifically reduced. The high frequency components remain to be muffled. The exhaust gas flows from chamber 38, through chambers 39, 40 and 41 and the pipe 45, and enters into the chamber 44, and thereafter flows back to the chamber 42 through pipe 46, and is finally exhausted through the pipe 47. Pipe 47 is sometimes called the "muffler outlet port". During this process, the high frequency pulsating pressure of the exhaust gas is attenuated, and consequently the higher frequency noise level is lowered. The construction to the right of wall 25a is sometimes called a "muffler", and any suitable muffler may be used, provided it is effective to muffle higher frequencies. This term is used in like manner in the other embodiments. The combination of muffler and silencing chamber reduces both low and high frequency components, and the expansion chamber (this feature being optional) reduces the total pressure. An optimally quieted stream is emitted from this structure.

FIGS. 10 and 11 show another example of a silencing device according to the present invention. This example was especially designed for a four-cycle internal combustion engine. In FIGS. 10 and 11, an exhaust pipe 51 is connected to an exhaust port of a four-cycle internal combustion engine (not shown). The exhaust pipe 51 has a uniform diameter along its entire length, and is closed at one end thereof by a reflecting wall 55a to form a silencing chamber 55b. An exhaust gas exit port 57 is provided at a location of the exhaust pipe forwardly (to the left in FIG. 10, representing a vehicle's forward direction of motion) from the reflecting wall, and will be located where the node of a standing wave will exist at common vehicle engine speeds as described above. An expansion chamber 60 is formed downstream from the exit port and illustrates that expansion is unnecessary to the feature of withdrawing gases near a node. Expansion can be eliminated or, as shown, can follow after the standing wave "treatment".

A muffler 58 is placed rearwardly from the expansion chamber. Chambers 68, 69, 70, 71, 72, and 73 are defined by partitions 61, 62, 63, 64, 65, and 66. Expansion chamber 60 and chamber 68 are connected to each other through a passage 59.

A pipe 75 with a number of perforations through its sidewall is mounted to extend through the partitions 61, 62, 63 and 64, and has a front end protruding into the chamber 68. Pipe 75 has a partition 75*a* between partitions 61 and 63. Partitions 62 and 64 have through-holes 62*a* and 64*a* provided at the peripheral portion thereof outside the pipe 75. Thus, a zig-zag passage is formed which extends from chamber 68 to the chamber 72, as shown by the arrows in FIG. 10. A pipe 76, having a number of perforations through the sidewall thereof, is placed between the partitions 65 and 66. Chamber 73 is filled with sound-absorbing material, such as glass wool.

Exhaust gas from the internal combustion engine flows from exhaust pipe 51 and leaves the silencing chamber through the exhaust gas outlet port 57, into the expansion chamber 60. The amplitude of the low frequency portions has been attenuated. The noise in the gas stream emitted from exit port 57 has a smaller amount of low frequency components than entered the silencing chamber.

Exhaust gas flows from the expansion chamber 60, where the total pressure value is lowered, then through the passage 59, and into the chamber 68. While the exhaust gas flows through the muffler 58, much of the energy of the high frequency noise component is absorbed, and then the stream is exhausted to atmosphere.

Figure 12:
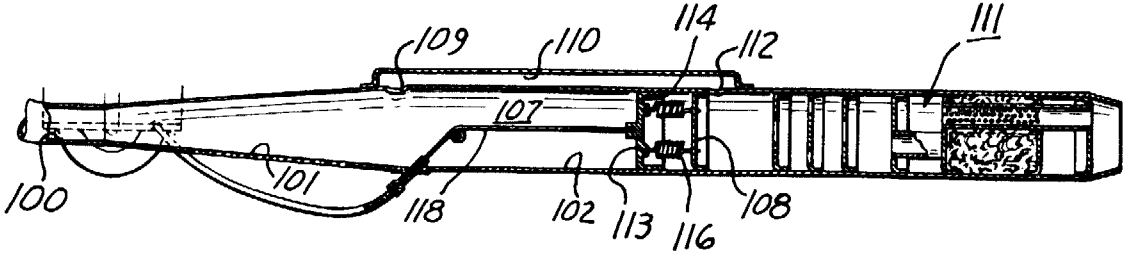

FIG. 12 shows another silencing system according to the invention, wherein an exhaust pipe 100 has a conical portion 101 expanding to an enlarged cylindrical portion 102. A silencing chamber 107 is formed which is bounded in part by reflecting wall 113 and by portions 101 and 102. This wall is formed on a piston-like body 114 in the cylindrical portion and is movable back and forth in the cylindrical portion. A tension cable 118 can pull it to the left in FIG. 12 against the resistance of tension springs 116 which are fixed to wall 108. When the cable is released, the springs tend to return body 114 to the right in FIG. 12. Movement of body 114 adjusts the position of the reflecting wall so that the node is optimally disposed axially adjacent to exit port 109. The body can be moved manually or automatically to compensate for the movement of the node with temperature changes, or can be moved to seek a more agreeable or efficient setting for removing other frequencies, for example at different speeds. More precisely stated, movement of wall 113 serves to keep the node of the pressure wave having the frequency in question located more nearly adjacent to the exit port. Exit port 109 communicates via passage 110 to the inlet port 112 of a muffler 111, all as heretofore described. Partition 108 separates the muffler from the silencing section. The embodiment of FIG. 12 provides means for adjusting the position of the node of the pressure wave having the frequency in question relative to the inlet port for optimum advantage. The term "frequency in question" is used herein to describe a frequency whose elimination is most sought after. In any practical engine installation there will be a certain lower frequency or group of frequencies preferentially to be attenuated. This is the "frequency in question".

Figure 13:
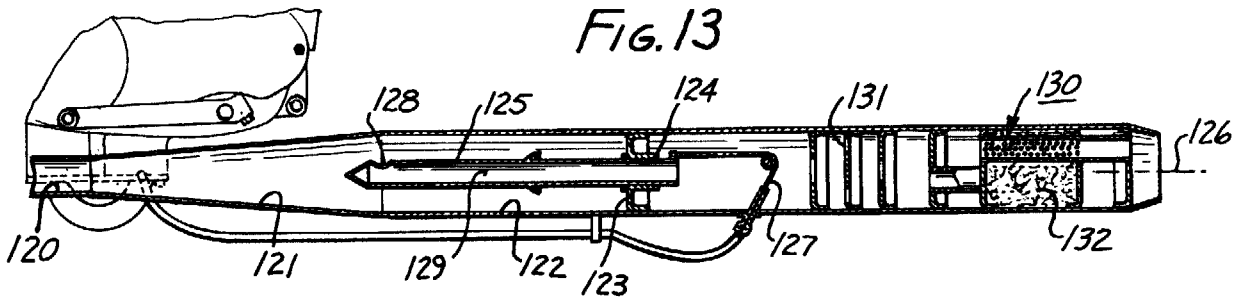

FIG. 13 shows a device with a similar objective to that of FIG. 12, except in this case it adjusts the position of the exit port relative to a fixed reflecting wall, rather than adjusting the position of the wall. The frequency desired to be silenced might be different, and the location of the most useful node might be at a different distance from the reflecting wall than would be the situation for the most useful node of another frequency. For example, at higher speeds, the frequency to be silenced might be higher, and the node would be closer to the wall. Then it is useful to be able to move the exit port (or the reflecting wall) so that this node is axially adjacent to the exit port.

In the embodiment of FIG. 13, exhaust gas is received from the engine through exhaust pipe 120, passes through a conical portion 121, and enters a cylindrical enlarged portion 122. This portion is bounded by a fixed reflecting wall 123, which wall has a hole 124 which slidingly accommodates a slidable tube 125 which is axially slidable along axis 126. A push-pull cable 127 is connected to the throttle and also to tube 125 for shifting the same in response to changes in engine speed.

Exit port 128 is formed in the wall of tube 125, instead of in the outer wall of the chamber, and exit gases flow through passage 129 in the tube 125 and pass into muffler 130, which includes a plurality of baffles 131 and conventional packing 132. The tube 125 forms an internal wall of the silencing chamber.

Figure 14:
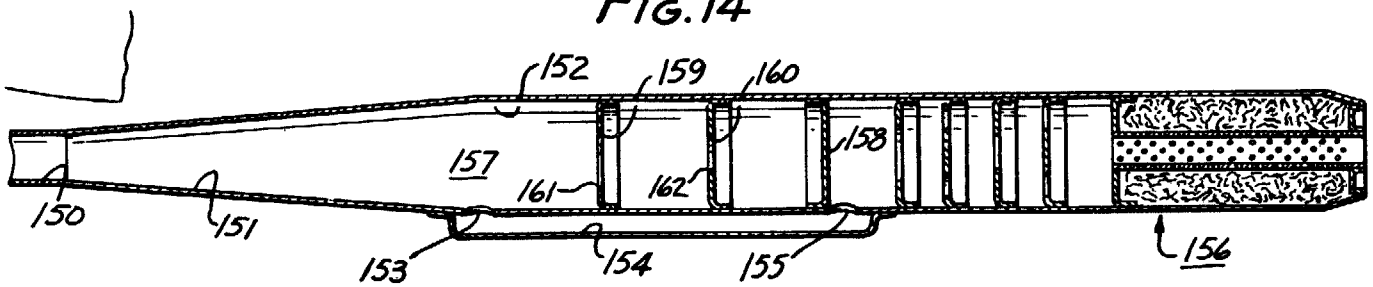
Figure 15:
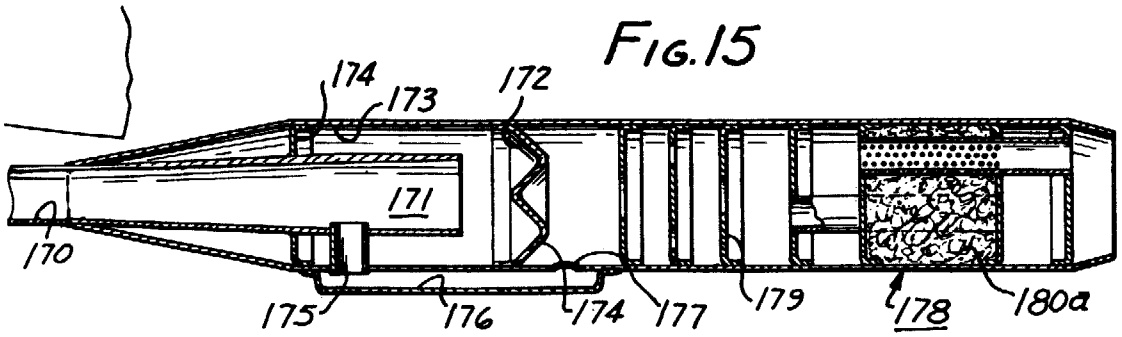

The embodiment of FIG. 14 is intended to provide a series of standing waves with the objective of increasing the likelihood of establishing a node adjacent to the exit port for a wider range of frequencies. For this purpose, the exhaust pipe 150 discharges into conical portion 151 which in turn discharges into a cylindrical enlarged portion 152. An exit port 153 is formed in the wall of cylindrical portion 152, and a passage 154 connects the exit port of the silencer section with the inlet port 155 of a muffler 156. The silencing chamber 157 is defined by an imperforate partition 158 and two perforated partitions 159, 160, which have respective holes 161, 162 therein. Hole 161 is larger than hole 162. It will thereby be seen that three standing waves will be formed, and, depending on the frequency, at least one of them, and probably more, is likely to establish a node axially adjacent to the exit port.

Because the allowable length of a silencer and muffler combination is likely to be limited, especially on motor bikes, it is advantageous to attempt to increase the path length within a construction of a given total length. For example, in FIG. 15 the exhaust pipe 170 enters the silencing chamber 171 and strikes a reentrant, circularly grooved, reflecting wall 172 which returns the standing wave, not only into the reverse direction, but also outwardly into an annular region 173 where reflecting wall 174 is located. A standing wave is formed by wall 174 and is reflected back into chamber 171 to form a node. Exit port 175 is formed at the desired location. The path to and from the reflecting wall is therefore "folded". Exit 175 discharges to a passage 176 which might be formed by a welded plate spaced from the outer wall of the construction that in turn communicates through an inlet port 177 to a muffler 178 that includes baffles 179 and packing 180*a*.

FIG. 16 shows another device according to the invention, wherein an exit port 180 discharges through a conical portion 181 to a silencer chamber 182 with a first leg 183 and a second leg 184. The legs are partially bounded by a deflector plate 185, which is disposed at about 450° angle to the axis 186 of the device so as to deflect the gases and waves sidewardly into the second leg toward a reflecting wall 187, which wall forms the standing wave. A node is formed adjacent to exit port 188. The exit port in turn communicates with an inlet port 189 of a muffler 190 comprising baffles 191 and a packing 192. This construction has the advantage of shortening the axial length of the device by providing a side leg.

FIGS. 17 and 18 show concentric alignments of the silencing chamber and the muffler. In FIG. 17 the entry port 195 enters a conical portion 196, and gases flow to a cylindrical portion 196*a*. These portions form silencing chamber 197. A plurality of exit ports 198 are placed relative to a reflecting wall 199 in accordance with the principles already discussed. This shows that a plurality of exit ports can be used so long as they are in a zone defined by the dimension "L", as previously discussed. A muffler 200 lies concentrically around the silencing chamber and shares a common wall with it, which constitutes substantial economic advantage. An expansion chamber 201 is formed to the left of a plurality of baffles 202 and a packing 203. Gases exit from the right-hand end of the device in FIG. 17.

FIG. 18 is a reversal of parts of FIG. 17. It includes an exhaust port 205 from the exhaust system. A conical portion 206 extends to a cylindrical portion 206*a* forming a cylindrical annular silencing chamber 207 around wall 206*b*. A reflecting wall 208 closes the right-hand end of the annular silencing chamber. It shares wall 206*b* with a silencing chamber. A muffler 209 is surrounded by the silencing chamber. Muffler 209 includes a pointed end 210 to deflect the gases into the annular silencing chamber, and an exit port 211 in wall 206*b*, located where the node is to be expected, to admit the gases to the muffler. The muffler comprises a plurality of baffles 212 and a packing 213, all for muffling the high frequency components.

FIG. 21 shows an enbodiment for still further reducing the length required for the device, wherein a motor bike 220 has a chassis 221 to receive a silencing chamber 222 and a muffler 223. The silencing chamber and muffler are made in accordance with any of the foregoing constructions. For example, a convenient pair of devices would be the silencing chamber of FIG. 2 and the muffler of FIG. 6. They are connected by a tube 224 which extends from the exit port of the silencing chamber to the inlet port of the muffler. In this manner these devices may be placed side by side on opposite sides of the motor bike, and the weight is more evenly distributed. The right-hand rear end of silencing chamber 222 is closed, and the right-hand rear end of the muffler is open, all exhaust gases departing from the muffler. The devices are made to look alike for cosmetic purposes.

It is known that much of the damage to catalytic elements is caused by vibration induced by the low frequency elements. It is also known that some catalytic elements operate best at low temperatures, and others at high temperatures. It is therefore a convenience of this invention that the catalytic element can be placed quite close to the hottest portions of the gas; that is, near the silencing chamber, or downstream where cooler, if desired. They have a substantially increased life because they operate in the presence of markedly diminished low frequency sound components.

FIG. 23, for example, shows a construction analogous to that of FIG. 6, and bears like numbers. The difference between the devices of FIGS. 23 and of FIG. 6 is the interposition of a catalytic element 230 inside the casing, directly between the muffler and the silencing chamber. It is held between two perforated plates 231 and 232, and acts on the gases at that point. The catalytic element is cooled by external radiation and tends to run cool. It can be put further downstream, if desired.

FIG. 24 shows the construction of FIG. 17 with a catalytic element 235 held between two perforated plates 236 and 237. Catalytic element 235 is active at cold temperatures and treats the exhaust stream when cold to remove excess hydrocarbons from it. After the engine is warmed up, catalyst 235 is no longer effective, but catalyst 238 downstream can be provided which is active at higher temperatures. It can also be provided in combination with a muffler structure.

In all embodiments of the invention, the silencing chamber has an "entrance port". It enters on the axis of the silencing chamber and faces the reflecting wall. In FIG. 6, for example, it is at the termination of the cylindrical exhaust pipe and at the start of the conical section 26. It is similarly located in the other embodiments, the conical portion, when used, being regarded as a portion of the expansion chamber.

The high frequency muffler means in every embodiment has a muffler inlet port and a muffler outlet port. In FIG. 6 the muffler inlet port is port 29. Its outlet port is pipe 47. In every embodiment, the muffler includes a sound-absorbing packing through which the entire exhaust stream passes while flowing from the muffler inlet port to the muffler outlet port.

In all embodiments of the invention (except for the embodiments of FIGS. 16, 21 and 22), the silencing chamber and the muffler means are coaxial in the sense that they are aligned with one another. The term "aligned with one another" includes the situation where they are next to one another, and also when one surrounds the other. Also, the silencing chamber and the muffler means are contained within a "single wall". In FIG. 6 the "single wall" forms the peripheral wall 25 of the silencing chamber and also an outer boundary of the muffler means. This is also the arrangement in FIGS. 12, 13, 14, 15, 23 and 24. In FIG. 10, where the expansion chamber is separate from the silencing chamber, it is wall 60 within which the silencing chamber is separately contained. The "single wall" in FIG. 17 is wall 196. It forms an outside boundary of the muffler. There is a wall 196 between the muffler and the silencing chamber which forms a boundary of both the silencing chamber and of the muffler means In FIG. 18 the "single wall" is wall 206*a* which forms an outer boundary of the silencing chamber. There is a wall 206*b* which forms an inner wall of the silencing chamber and an outer boundary of the muffler means. It will be noted that in both the embodiments of FIGS. 17 and 18 the muffler means and silencing chamber are coaxial with one another, although one surrounds the other instead of being axially spaced-apart as in the other embodiments of the invention (excepting FIGS. 16, 21 and 22, of course).

To summarize, this invention provides an exceptionally useful means and method to eliminate both low and high frequencies from exhaust streams, especially in small devices where a compact size and minimum length are needed. It provides a means for disposing of low frequency components, for example on motorcycles, which heretofore have been unable to utilize the long mufflers required by the prior art, because of size limitations. The method of this invention is first to eliminate the low frequency components in a silencing chamber of the type described, and then to eliminate the high frequency components in a muffler.

It has been found that, if the total volume of the system downstream from the entrance port to the silencer exceeds the total displacement of the engine by a factor of between about 6 to about 12, and preferably about 8, improved silencing is attained by virtue of the resulting expansion of the gases.

This device provides a remarkably quiet exhaust stream, using a minimum amount of material of its construction, and occupying a minimum volume.

This invention is not to be limited by the embodiments shown in the drawings and described in the description, which are given by way of example and not of limitation, but only in accordance with the scope of the appended claims.

I claim:

1. The method of silencing noise in the exhaust stream from an internal combustion engine, having a noise component intended to be silenced which has a relatively low frequency, and also high frequency noise components, comprising:

a. in a silencing chamber, forming a standing wave from said low frequency noise component, said standing wave having a node with least amplitude along its axis within said silencing chamber;

b. withdrawing the exhaust stream from the silencing chamber in a direction lateral relative to said axis of said standing wave at an axial location substantially axially aligned with said node; and c. thereafter passing the exhaust stream withdrawn from the silencing chamber through a muffler adapted to muffle the high frequency components.

2. The method according to claim 1 in which the said standing wave is axially moved in said silencing chamber to place said node at the place of withdrawing said exhaust stream.

3. The method according to claim 1 in which the said axial location of withdrawing said exhaust stream is axially moved to place it axially where the node is located.

* * * * *